United States Patent [19]

Uchida et al.

[11] Patent Number: 4,464,161

[45] Date of Patent: Aug. 7, 1984

[54] SAFETY DEVICE FOR CENTRIFUGAL SEPARATORS

[75] Inventors: Tadahiro Uchida, Sayama; Hiizu Wakita, Tokyo; Minoru Hara, Sakado, all of Japan

[73] Assignee: Kabushiki Kaisha Kubota Seisakusho, Tokyo, Japan

[21] Appl. No.: 464,815

[22] Filed: Feb. 8, 1983

[30] Foreign Application Priority Data

Feb. 19, 1982 [JP] Japan ..... 57-23381

[51] Int. Cl.[3] ..... B04B 5/02

[52] U.S. Cl. ..... 494/7; 494/10; 494/12; 494/16

[58] Field of Search ..... 422/72; 494/7, 10, 12, 494/16, 60

[56] References Cited

U.S. PATENT DOCUMENTS

| | | | |
|---|---|---|---|
| 3,244,363 | 4/1966 | Hein | 494/16 |
| 3,750,941 | 8/1973 | Drucker | 494/16 |
| 3,970,245 | 7/1976 | Aeschlimann | 494/12 |

*Primary Examiner*—Robert W. Jenkins
*Assistant Examiner*—Arthur D. Dahlberg
*Attorney, Agent, or Firm*—Pollock, VandeSande and Priddy

[57] ABSTRACT

A centrifugal separator capable of selectively mounting sedimentation tubes or capillary tubes on a rotor includes a container receptacle mounted in an outer box of the separator for receiving sedimentation tube containers. When the sedimentation tube containers are received in the container receptacle, their presence is detected to enable the rotor to rotate at a relatively high speed required when the capillary tubes mounted on the rotor.

15 Claims, 13 Drawing Figures

SAFETY DEVICE FOR CENTRIFUGAL SEPARATORS

BACKGROUND OF THE INVENTION

The present invention relates to a safety device for use in a centrifugal separator in which sedimentation tubes or capillary tubes may be mounted for centrifugal separation of substances contained therein, the safety device being effective in preventing the centrifugal separator with the sedimentation tubes mounted from rotating at the high speed of rotation required for centrifugal separation in the capillary tubes.

There has been put to use a centrifugal separator having two selective modes of operation: In one mode, sedimentation tubes with blood samples contained therein are mounted on a rotor for centrifugal separation of the blood samples; and in the other mode, blood samples are placed in capillary tubes that are mounted on the rotor and subjected to centrifugal separation for hematocrit determination.

The rotor of the centrifugal separator is normally rotated at about 12,000 rpm for hematocrit measurements, and at about 4,000 to 5,000 rpm for blood sample separation. For such blood sample separation with sedimentation tubes mounted in the centrifugal separator, the operator manipulates a selector switch on the control panel to select low-speed rotation for driving the rotor to rotate substantially at the speed ranging from 4,000 to 5,000 rpm. When hematocrit determination is to be made with capillary tubes mounted in the centrifugal separator, the operator shifts the selector switch to select high-speed rotation for rotating the rotor approximately at the high-speed of 12,000 rpm. This manual control however has a tendency for erroneous switching operation. In particular, when the operator shifts the selector switch to the high-speed side in error with the sedimentation tubes mounted for blood sample separation, the rotor is caused to rotate at 12,000 rpm, with the result that sedimentation tube containers are subjected to intensive centrifugal forces, and the containers or the sedimentation tubes may be broken or otherwise damaged.

SUMMARY OF THE INVENTION

It is an object of the present invention to provide a safety device in a centrifugal separator for eliminating the prior problem experienced with switching between a mode of operation in which a rotor rotates at a low speed for blood sample separation and another mode of operation in which the rotor rotates at a high speed for hematocrit determination, the safety device being capable of switching without error between the speed of rotation of the rotor with sedimentation tubes mounted thereon and the speed of rotation of the rotor with capillary tubes mounted thereon.

According to the present invention, a container receptacle or receptacles for receiving sedimentation tube containers are mounted in an outer box of a centrifugal separator. A detecting means is associated with the container receptacle for detecting when the sedimentation tube containers are received in the container receptacle. When the detecting means detects the sedimentation tube containers received in the receptacle, a speed setting means is allowed to be set to a high speed for capillary tubes mounted on the rotor. Even when a selector switch is erroneously actuated for the high-speed rotation for separation in the capillary tubes while sedimentation tubes are being mounted on the rotor rather than being received in the receptacles, the rotor is prevented from being rotated at the high speed since the sedimentation tube containers are not received in the container receptacles.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1B:
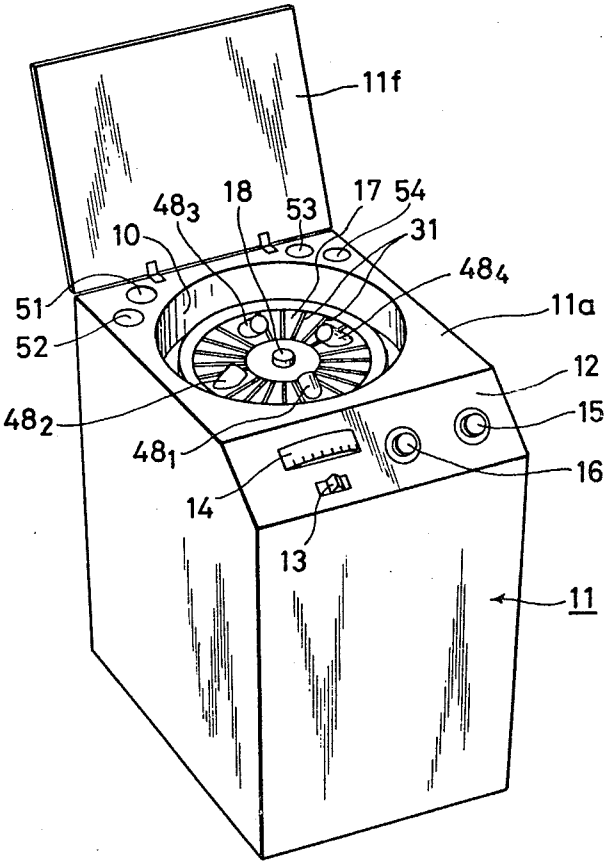
FIGS. 1A through 1D are perspective views of centrifugal separators wherein receptacles for receiving sedimentation tube containers are provided at various portions of the outer boxes of the centrifugal separators having safety devices according to the present invention.
Figure 1A:
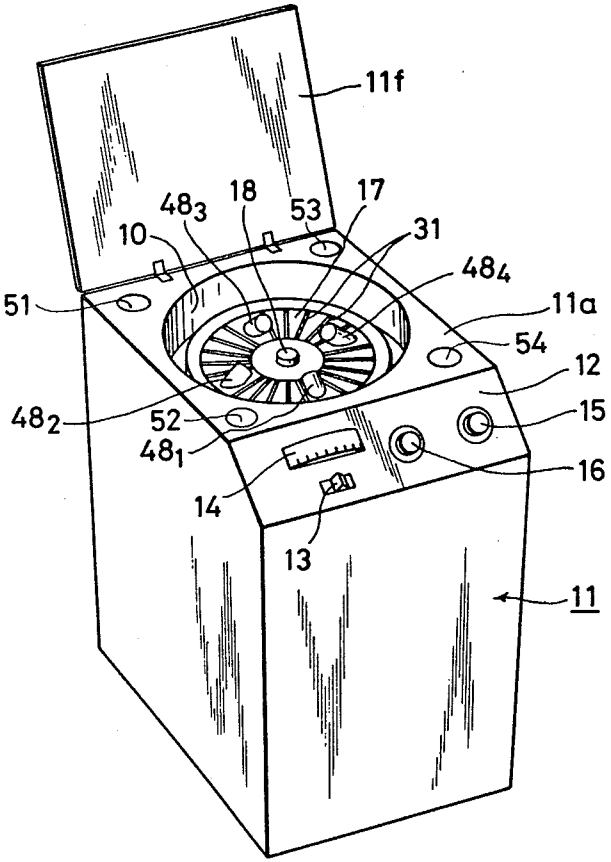

FIG. 1A shows an appearance of a centrifugal separator having a safety device according to the present invention. The centrifugal separator includes an outer box 11 having a square upper panel 11*a* with a circular opening defined therein. An inner housing 10 depends from the peripheral edge of the circular opening and is accommodated in the outer box 11. A rotor 17 is rotatably disposed in the inner housing 10. Although not shown, a motor is mounted in the outer box 11 below the inner housing 10 and has a rotatable shaft 18 projecting upwardly into the inner housing 10, the rotor 17 being supported on the shaft 18. A plurality of tube retainers $\mathbf{48}_1$ through $\mathbf{48}_4$ are formed on the rotor 17 for retaining therein sedimentation tube containers $\mathbf{19}_1$ through $\mathbf{19}_4$. Near the four corners of the upper panel 11*a* are respectively provided four receptacles 51–54 for receiving therein the sedimentation tube containers $\mathbf{19}_1$–$\mathbf{19}_4$ when they are not in use. As will be explained later, the receptacles constitute a part of the safety device of the present invention.

Figure 1D:
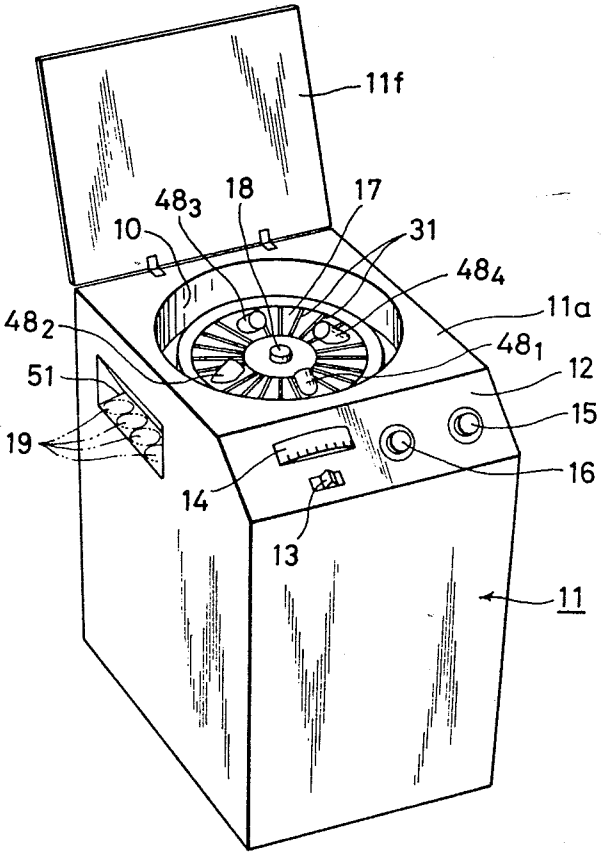
Figure 1C:
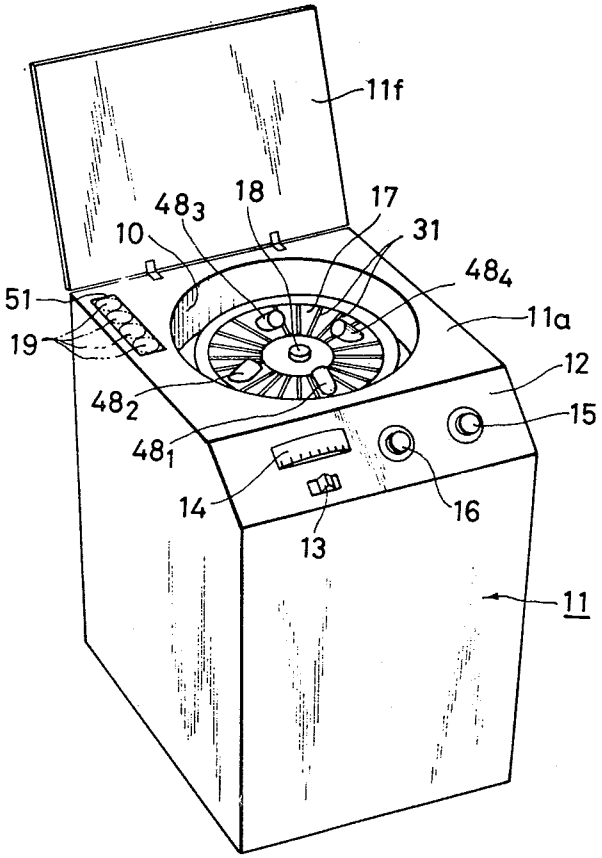

The centrifugal separators shown in FIGS. 1B, 1C and 1D have the same construction as that of FIG. 1A except for that in FIG. 1B each two of the four receptacles 51–54 are formed near the two rear corners of the upper panel 11*a*; in FIG. 1C a receptacle 51 for receiving a plurality of sedimentation tube containers is formed in a marginal area of the upper panel 11*a*; and in FIG. 1D a receptacle or receptacles for receiving the sedimentation tube containers are formed in a side wall of the outer body 11. The rotor 17 has a plurality of radial grooves 31 for removably mounting capillary tubes therein. A cover 11*f* is hinged to the outer box 11 for covering the circular opening in the upper panel 11*a*. The cover 11*f* is operatively related to the motor such that the switch for driving the rotor 17 cannot be turned on unless the rotor 17 is covered by the cover 11*f* after sedimentation or capillary tubes have been mounted on the rotor 17.

The outer box 11 includes a front panel having an upper inclined end portion serving as a control panel 12. A selector switch 13 for selecting high-speed and low-speed modes of operation and a tachometer 14 for indicating rpm of the rotor 17 are mounted on a lefthand portion of the control panel 12. The control panel 12 also has on its lefthand portion a setting unit 15 for selecting a setting for speed of rotation in the range of from 0 to 12,000 rpm, and a timer switch 16 capable of setting a time interval in which the separator operates in the range of from 0 to 15 minutes.

Figure 2:
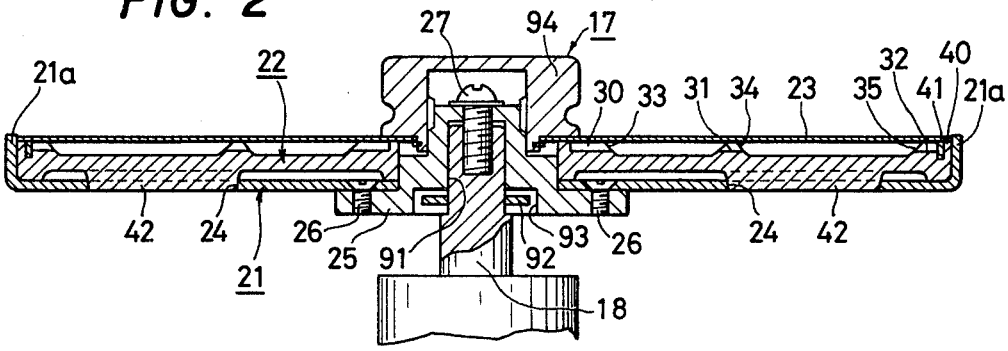
FIG. 2 is a cross-sectional view of a rotor for mounting capillary tubes thereon.
Figure 3:
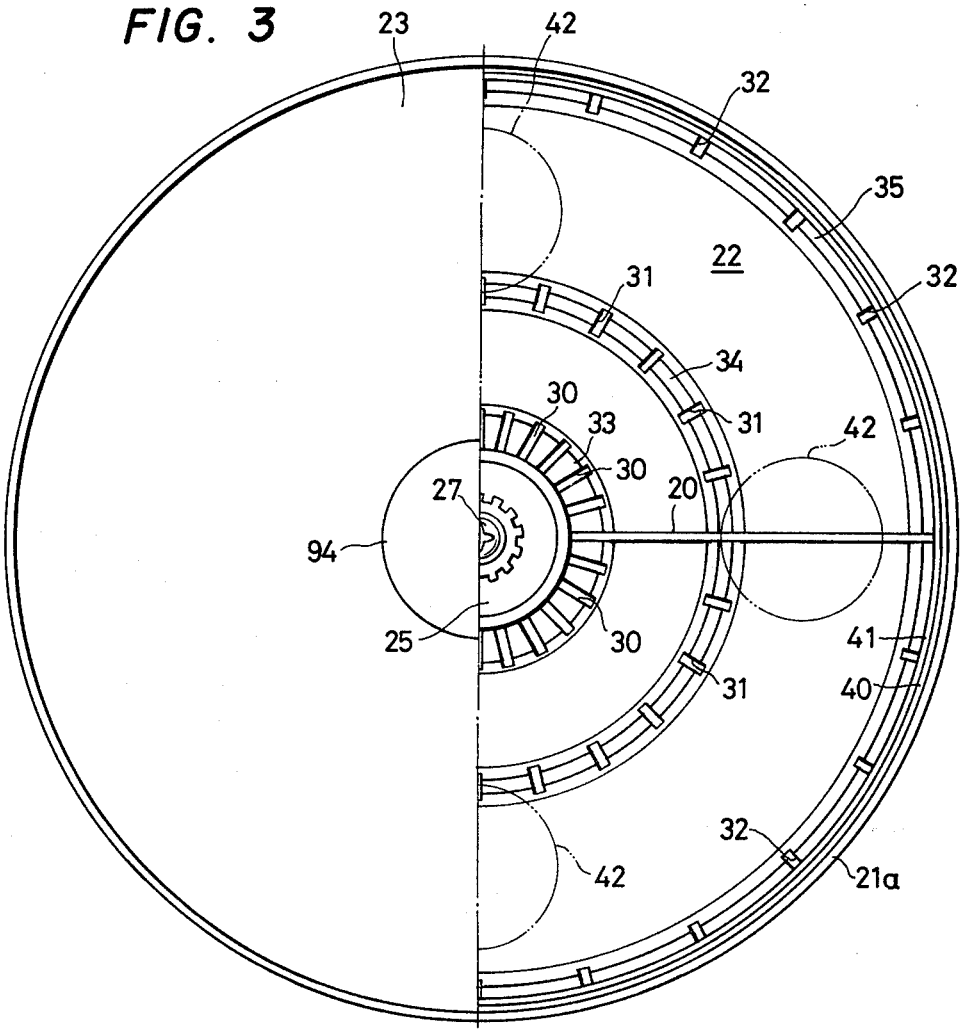
FIG. 3 is a plan view of the rotor of FIG. 2 with one half of a cover thereof being cut away.
Figure 4:
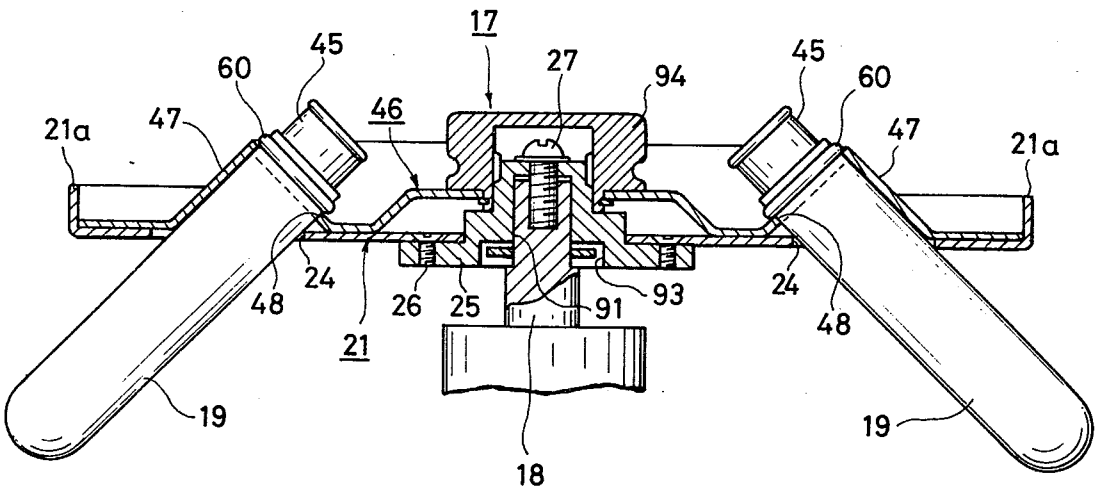
FIG. 4 is a cross-sectional view of a rotor for mounting sedimentation tube containers thereon.

FIGS. 2 and 4 show another type of a rotor different from that shown in FIG. 1A, where two different holder plates are provided for sedimentation tube containers and for capillary tubes and the two holder plates can be selectively mounted on a bottom plate to form a rotor for sedimentation tubes or a rotor for capillary tubes. FIGS. 2 and 3 illustrate the rotor 17 by way of example which is shown as readied for mounting capillary tubes thereon. The rotor 17 comprises a circular bottom plate 21, a capillary tube holder plate 22 placed thereon, and a cover plate 23 covering the capillary tube holder plate 22. The circular bottom plate 21 has a plurality of circular holes 24 spaced equidistantly from the rotatable shaft 18 and located at equal angular intervals therearound. The bottom Plate 21 includes an outer peripheral edge bent upwardly (as shown in FIG. 2) into a peripheral wall 21*a*. An attachment 25 is fitted in a central hole defined centrally in the bottom plate 21 and has an integral flange held against and secured to the lower surface of the bottom plate 21 by means of screws 26. The attachment 25 has an attachment hole 91 extending upwardly from its bottom surface, in which an end of the rotatable shaft 13 is inserted. An upper end of the attachment 25 is fastened by a screw 27 to the rotatable shaft 18. An engagement pin 92 is inserted transversely through the rotatable shaft 18 and has ends positioned in an engagement recess 93 defined in the lower surface of the attachment 25. Therefore, the rotatable shaft 18 and the attachment 25 are held in engagement with each other for corotation.

The capillary tube holder plate 22 is circular in shape and made of a material having a small thermal conductivity such for example as synthetic resin, the holder plate 22 having a central hole for fitting engagement with the attachment 25. The capillary tube holder plate 22 is substantially fitted on the bottom plate 21 and surrounded by the peripheral wall 21*a*. An upper surface of the capillary tube holder 22 has integral ring-shaped ridges 33, 34, 35 extending concentrically with the rotatable shaft 13 and having slots 30, 31, 32, respectively, defined radially with respect to the rotatable shaft 18 for holding capillary tubes therein. The bottoms of the slots 30, 31, 32 are made higher than the upper surface of the holder plate 22. A ring-shaped keeper 40 projects integrally upwardly from the outer peripheral edge of the capillary tube holder plate 22 for preventing the capillary tubes from being forced radially outwardly. A protective layer 41 of an elastic material is held against an inner peripheral surface of the keeper 40. Under centrifugal forces applied, capillary tubes 20 are pushed against the keeper 40 with the protective layer 41 interposed therebetween. Thus, the capillary tubes 20 are protected by the protective layer 41 from unwanted damage.

The capillary tube holder plate 22 has a plurality of circular projections 42 integral with the lower surface thereof and fitted respectively in the circular holes 24 in the bottom plate 21 for preventing the capillary tube holder plate 22 from slipping on the bottom plate 21 on rotation of the rotor 17. The circular projections 42 have projecting ends lying flush with the lower surface of the bottom plate 21 so that there will be generated no swirls of air on the lower surface of the bottom plate 21.

The cover plate 23 is placed fully over the capillary tube holder plate 22 and has a central hole in which a cap 94 is fitted, the cap 94 projecting upwardly. An upper end of the attachment 25 is threaded into the cap 94.

The rotor 17 is assembled as shown in FIG. 4 when mounting sedimentation tubes thereon. For doing so, the capillary tube holder plate 22 is detached from the bottom plate 21, and a sedimentation tube holder plate 46 is mounted on the bottom plate 21. The sedimentation tube holder plate 46 is a circular in shape as a whole and fitted on the bottom plate 21 and surrounded by the peripheral wall 21*a*. The sedimentation tube holder plate 46 has an annular pressed-out ridge 47 of an inverted V-shaped cross section extending concentrically with the attachment hole 91 or the rotatable shaft 18. The annular ridge 47 has a plurality (four in the illustrated embodiment) of tube attachment holes 48 defined in a slant surface thereof facing the attachment 25 and located at equally angular intervals around the attachment hole 91. Sedimentation tube containers 19 are inserted respectively in the tube attachment holes 48 and have larger-diameter necks 60 held in engagement with peripheral edges of the tube attachment holes 48. The sedimentation tube containers 19 are held against the underside peripheral surface of the ridge 47 and project through the circular holes 24 downwardly of the bottom plate 21. Sedimentation tubes 45 are inserted respectively in the sedimentation tube containers 19 thus mounted.

Figure 5:
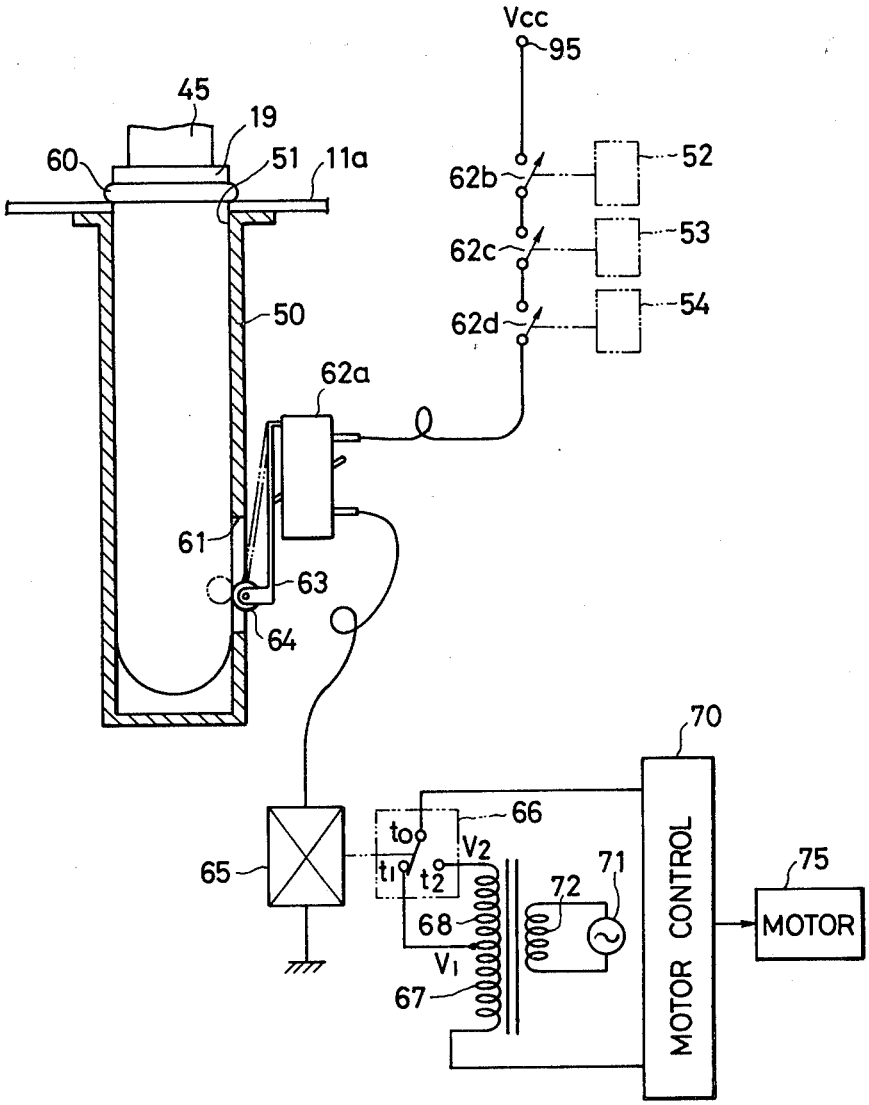
FIG. 5 is a schematic view showing a container receptacle, a detector means, and a speed setting means in the safety device of the present invention.

According to the present invention, the outer box 11 of the centrifugal separator has container receptacles for housing sedimentation tube containers. As shown in FIG. 1A, for example, the upper panel 11*a* of the outer box 11 has receptacle holes 51 through 54 respectively at its four corners. As illustrated in FIG. 5, a cylindrical container receptacle 50 is mounted on and disposed below the upper panel 11*a* in registry with each of the receptacle holes, here the receptacle hole 51. The cylindrical container receptacle 50 has an inside diameter slightly larger than the outside diameter of the sedimentation tube container 19 and is shaped to allow insertion therein of the sedimentation tube container 19. When the sedimentation tube containers 19 are inserted respectively in the receptacle holes 51–54, the larger-diameter necks 60 near the open ends of the containers 19 engage the edges of the receptacle holes 51–54 and hence the sedimentation tube containers 19 are retained on the outer box 11. Each of the container receptacles 50 is not necessarily be cylindrical, but can be of any shape which defines a position where a corresponding one of said sedimentation tube containers is received.

Each of the container receptacles 50 has a small opening 61 defined in its sidewall. A microswitch 62*a* is mounted in position outside of the receptacle 50 in the vicinity of the small opening 61. The microswitch 62*a* has an actuator lever 63 having on its distal end a roller 64 which is normally disposed in the receptacle 50 through the small opening 61. When the sedimentation tube container 19 is inserted in the receptacle hole 51, its sidewall pushes the roller 64 out of the small opening 61 against the resiliency of the actuator lever 63, whereupon the microswitch 62*a* is turned on.

The other receptacle holes 52 through 54 are equipped with microswitches 62*b* through 62*d*, respectively, of the same construction as that of the microswitch 62*a*. The microswitches 62*a* through 62*d* are connected in series with each other to form a series-connected circuit having one end coupled to a power supply terminal 95 and the other end grounded through a relay 65. When all of the receptacle holes 51 through 54 receive the sedimentation tube containers 19, respectively, an operating current flows through the relay 65.

A changeover switch 66 is controllably connected to the relay 65. While the relay 65 remains de-energized, the changeover switch 66 has its terminals $t_0$, $t_1$ electrically connected. When the relay 65 is actuated, terminals $t_0$, $t_2$ of the changeover switch 66 are electrically connected to each other. With the terminals $t_0$, $t_1$ connected, a first coil 67 is connected to a motor control circuit 70. When the terminals $t_0$, $t_2$ are connected, the series connection of the first coil 67 and a second coil 68 is connected to the motor control circuit 70. A primary coil 72 is transformer-coupled to the secondary coil comprising the first and second coils 67, 68 and connected to a power supply 71 such as a commercial power supply.

When the terminals $t_0$, $t_1$ of the changeover switch 66 are connected, that is, when the sedimentation tube container 19 is not received in at least one of the receptacle holes 51 through 54, a voltage $V_1$ is applied to the motor control circuit 70 by the coils 67. When the terminals $t_0$, $t_2$ of the changeover switch 66 are connected, i.e., when the sedimentation tube containers 19 are received in all of the receptacle holes 51 through 54, a voltage $V_2$, which is higher than the voltage $G_1$, is generated across the series connection of the first and second and coils 67, 68 is applied to the motor control circuit 70.

A motor 75 for driving the rotor 17 is connected to the motor control circuit 70. When the voltage $V_1$ is imposed on the motor control circuit 70, the motor 75 rotates at a relatively low speed with the maximum speed of 5,000 rpm, for example. With the voltage $V_2$ applied to the motor control circuit 70, the motor 75 is caused to rotate at a relatively high speed having the maximum of 12,000 rpm, for example. The rpm of the motor for each of low-speed and high-speed modes of rotation can be selected by adjusting the speed setting unit 15 (FIG. 1).

Figure 6:
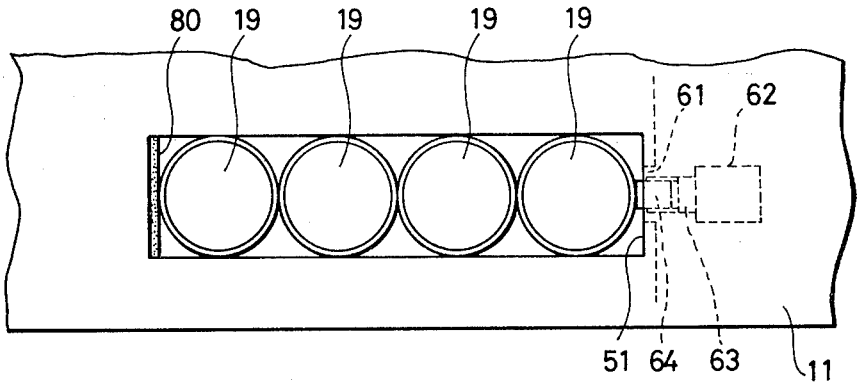
FIG. 6 is a plan view of a receptacle and a detector means in a safety device according to another embodiment of the present invention.
Figure 7:
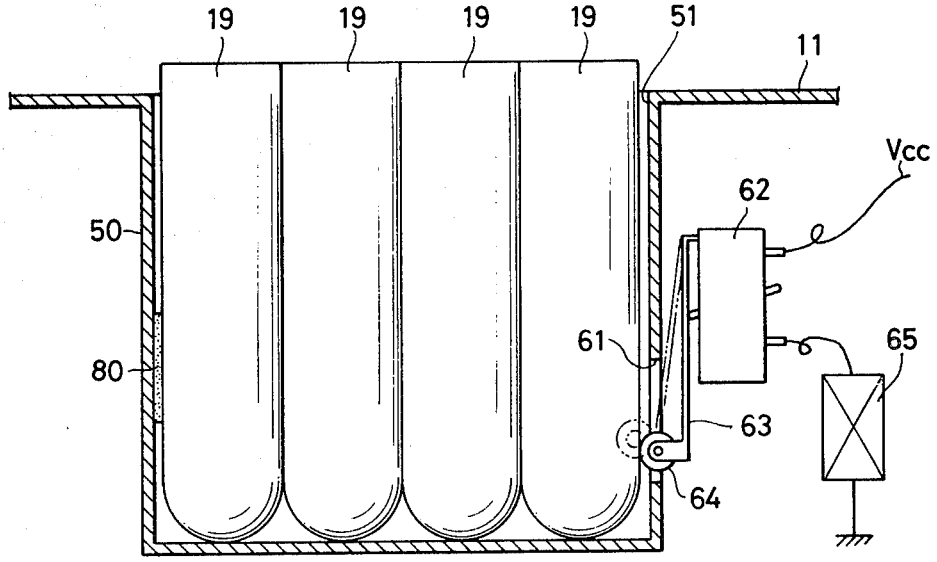
FIG. 7 is a cross-sectional view of the receptacle shown in FIG. 6.

FIGS. 6 and 7 are illustrative of a container receptacle according to a second embodiment of the present invention. The outer box 11 has a single receptacle hole 51 and supports a single microswitch 62. The receptacle holes 51 has a substantially rectangular opening with its length being slightly larger than the product of the number of sedimentation tube containers 19 that can be mounted on the rotor 17 at the same time and the outside diameter of each of the sedimentation tube containers 19. A receptacle 50 in the form of a rectangular parallelepiped is mounted in the outer box 11 in registry with the receptacle hole 51. The receptacle 50 has a small opening 61 defined in a longitudinal end wall thereof, and a cushioning plate 80 attached to an opposite longitudinal end wall thereof. The microswitch 62 is disposed adjacent to the small opening 61 and includes an actuator lever 63 having on a distal end a roller 65 positioned in the receptacle 50 through the small opening 61. The microswitch 62 is connected in series with a relay 65. A voltage Vcc from a power supply is applied across the series-connected microswitch 62 and relay 65. Although not shown, the relay 65 controls a changeover switch constructed and wired as shown in FIG. 5.

With the arrangement of the second embodiment, the microswitch 62 is turned on only when all sedimentation tube containers 19 are received in the receptacle hole 51, thereby passing an operating current through the relay 65 to enable the rotor 17 to rotate at a high speed.

Figure 8:
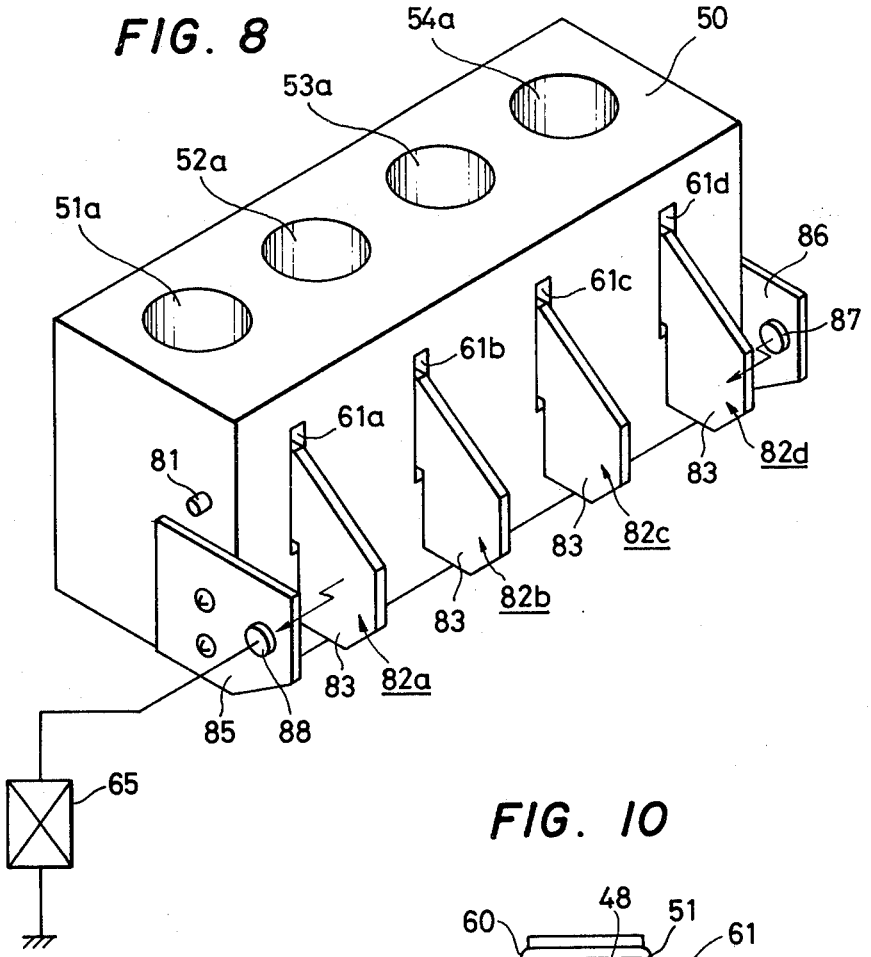
FIG. 8 is a perspective view of a receptacle and a detector means in a safety device according to still another embodiment of the present invention.
Figure 10:
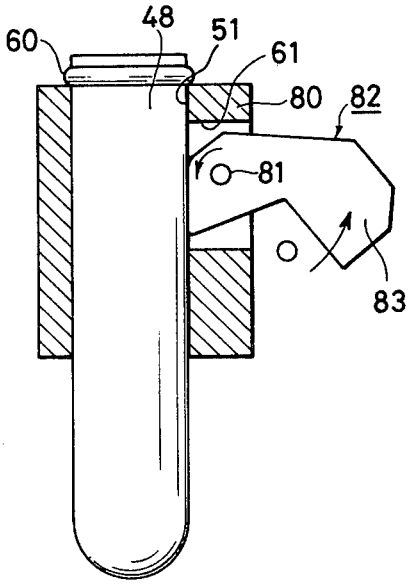
FIG. 10 is a cross-sectional view of the receptacle of FIG. 9 having a sedimentation tube container mounted therein.
Figure 9:
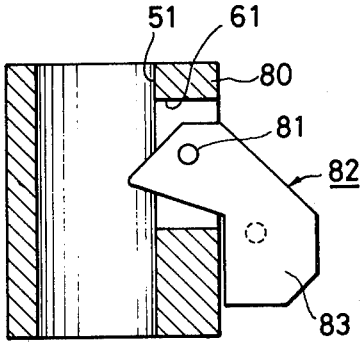
FIG. 9 is a cross-sectional view of the receptacle of FIG. 8 with a swingable body.

FIGS. 8 through 10 shows a receptacle construction according to a third embodiment of the present invention. As shown in FIG. 8, a receptacle 50 comprises a chamber in the form of a rectangular parallelepiped mounted in a suitable empty space within the outer box 11. The chamber 50 includes an upper plate having receptacle holes 51*a* through 54*a*. The outer box 11 has holes (not shown) held in registry with the receptacle holes 51*a* through 54*a*, or a rectangular hole (not shown) shared by the receptacle holes 51*a* through 54*a*. The chamber 50 also has in a sidewall thereon vertical slit-shaped small openings 61*a* through 61*d* vertically aligned with the receptacle holes 51*a* through 54*a*, respectively. A common shaft 81 extends longitudinally through the chamber 50 adjacent to and across the small openings 61*a* through 61*d*. A plurality of swingable plates 82*a* through 82*d* are angularly movably supported on the common shaft 81 and have portions received respectively in the small openings 61*a* through 61*d*. When no sedimentation tube container is received in the holes 51*a* through 54*a*, shield ends 83 of the swingable plates 82*a* through 82*d* are stably held against an outer side surface of the chamber 50 as shown in FIG. 9. A pair of attachment plates 85, 86 are secured to ends of the chamber 50 at opposite ends of the array of the shield ends 83 of the swingable plates 82*a* through 82*d*. A light-emitting element 87 is mounted on the attachment plate 86 on its face confronting the swingable plate 82*d*. A photodetector element 88 is mounted on the attachment plate 85 in alignment with the light-emitting element 88. A beam of light emitted from the light-emitting element 88 is normally blocked by the shield ends 83 and does not reach the photodetector 88.

As shown in FIG. 9, ends of the swingable plates 82*a* through 82*d* when they are in free states project into the chamber 50. When sedimentation tube containers 19 are inserted respectively in all of the holes 51*a* through 54*a*, the swingable plates 82*a* through 82*d* are caused to turn in the direction of the arrows (FIG. 10) about the shaft 81 to lift the shield ends 83 of the swingable plates away from the chamber 50, thus allowing a beam of light from: the light-emitting element 87 to arrive at the photodetector 88. Then, the photodetector 88 produces an output to energize a relay 65 connected thereto. Since the relay 65 is in circuit with the motor through a control circuit arrangement identical with that shown in FIG. 5, the same motor control operation can be performed as that described with reference to FIG. 5. With the arrangement of the third embodiment, the rotor 17 can be rotated at a higher speed only when all of the sedimentation tube containers 19 are placed respectively in the holes 51*a* through 54*a*.

In FIG. 8, all of the sedimentation tube containers 19 are detected for their presence by a single pair of light-emitting element 87 and photodetector element 88. Where the outer box 11 has no space available for mounting the chamber 50, the holes 51*a*, 52*a*, 53*a*, 54*a*, or pairs of these holes may be provided separately, and the light-emitting element 87 and the photodetector 88 may be provided for each of such separate holes or pairs of holes. A circuit should then be provided for detecting when all of the photodetectors 88 have received light emitted from the light-emitting elements 87 to energize the relay 65 with an output from the circuit. Also, instead of using the microswitch 62 in FIGS. 6 and 7, it is possible to adopt a swingable plate shown in FIGS. 9 and 10 and a pair of a light-emitting element and a photodetector in an opposing relation across the swingable plate.

As described above, the centrifugal separator of the present invention cannot be driven at the higher speed for separation in capillary tubes even if the selector switch 13 is selected for the high-speed operation, unless all of the sedimentation tube containers 19 are removed from the rotor 17, received respectively in the receptacle holes 51 through 54 (51*a* through 54*a*) in the outer box 11, and detected by the detecting means.

In FIG. 1A, the inner housing 10 is generally cylindrical in shape, and the outer box 11 is in the form of a rectangular parallelepiped, with spaces created in the outer box 11 below the four corners of the upper panel 11*a*. Since the receptacle holes 51–54 can be defined in such spaces, there is no need for providing additional spaces for receiving tube containers. The receptacle holes 51–54 defined in the upper panel 11*a* can easily be seen by the operator, allowing the operator to pay much attention to distinguish between high-speed and low-speed modes of operation of the centrifugal separator.

Where the receptacle holes for sedimentation tube containers cannot be defined in front corners of the upper panel 11*a* because of an arrangement of the control panel 12 or a design of the separator, the receptacle holes 51, 52, 53, 54 may be paired and defined in rear corners of the upper panel 11*a* as illustrated in FIG. 1B. The container receptacle 50 for receiving four tube containers as shown in FIG. 7, or the chamber 50 as shown in FIG. 8 may for example be provided on a rear portion of the upper panel at one side thereof, as illustrated in FIG. 1C. As shown in FIG. 1D, the receptacle holes 51 through 54 for sedimentation tube containers may be defined in a side plate of the outer box 11 at a vertically intermediate position. With this arrangement, it is preferable that the surface in which the receptacle holes 51–54 are formed be inclined to facilitate insertion and removable of the sedimentation tube containers. The receptacle for the sedimentation tube containers may otherwise be disposed inwardly of a front plate of the outer box. The rotor 17 is not limited to the illustrated embodiments.

Although certain preferred embodiments have been shown and described, it should be understood that many changes and modifications may be made therein without departing from the scope of the appended claims.

What is claimed is:

1. A safety device in a centrifugal separator having an outer box and a rotor disposed therein and capable of selectively mounting thereon a plurality of sedimentation tube containers each capable of receiving therein a sedimentation tube containing a sample to be subjected to centrifugal separation and mounting thereon a plurality of capillary tubes for centrifugal separation of samples contained therein, said safety device comprising:

receptacle means mounted in said outer box for receiving all of the sedimentation tube containers from the exterior of the outer box;

detecting means associated with said receptacle means for detecting when all of the sedimentation tube containers are received in said receptacle means; and setting means responsive to an output from said detecting means for enabling the rotor to rotate at a relatively high speed required when the capillary tubes are mounted on the rotor.

2. A safety device according to claim 1, wherein said detecting means comprises the same number of detectors as the number of said sedimentation tube containers for detecting the presence thereof in said receptacle means.

3. A safety device according to claim 2, wherein each of said detectors is a microswitch disposed adjacent said receptacle means, each said microswitch having an actuator lever extending into said receptacle means so as to be actuated by corresponding one of said sedimentation tube containers inserted into said receptacle means.

4. A safety device according to claim 3, wherein said receptacle means comprises the same number of container receptacles as the number of said sedimentation tube containers, each of said container receptacles defining a position for receiving corresponding one of said sedimentation tube containers and having an upper opening for receiving thereinto the sedimentation tube container and an end portion of the actuator lever of each of said microswitches being positioned in the corresponding one of said container receptacles.

5. A safety device according to claim 4, wherein said outer box includes a square upper panel having a circular opening, and an inner housing attached at an upper edge thereof to a peripheral edge of said circular opening and accommodated in said outer box, said rotor being disposed in said inner housing, said upper panel having the same number of receptacle holes as the number of said sedimentation tube containers, said container receptacles being attached to said outer box in communication with said receptacle holes through said upper openings of the container receptacles, respectively.

6. A safety device according to claim 5, wherein all of said receptacle holes are defined in the four corner areas of said upper panel.

7. A safety device according to claim 5, wherein all of said receptacle holes are defined in the two rear corner areas of said upper panel.

8. A safety device according to claim 1, wherein said receptacle means comprises a single container receptacle having an elongated upper opening for receiving thereinto an array of said sedimentation tube containers and said detecting means comprises a switch means disposed adjacent one end side of said container receptacle, said switch means having an actuator extending into said container receptacle so as to be actuated only when said container receptacle is fully inserted with said sedimentation tube containers.

9. A safety device according to claim 8, wherein said receptacle means is mounted to a marginal area of a square upper panel of said outer body.

10. A safety device according to claim 8, wherein said receptacle means is mounted to one of side walls of said outer body.

11. A safety device according to claim 8, wherein said switch means is a microswitch.

12. A safety device according to claim 8, wherein said switch means is an optical switch which is actuated by a portion of said actuator.

13. A safety device according to claim 1, wherein said detecting means comprises a plurality of swingable plates disposed adjacent said receptacle means, a portion of each of said swingable plates being normally positioned in said receptacle means at a position where a corresponding one of said sedimentation tube containers is to be received, said detecting means further comprising a light-emitting element and a photodetector apart from each other between which said swingable plates are normally positioned so that only when all of said sedimentation tube containers are inserted, said portions of the swingable plates are actuated to swing said swingable plates out of a line connecting said light-emitting element and photodetector, thereby to detect the presence of all of said sedimentation tube containers in said receptacle means.

14. A safety device according to claim 13, wherein said receptacle means is shaped to receive an array of all of said sedimentation tube containers.

15. A safety device according to any one of claim 2, 3, 4, 5, 6 or 7, wherein all of said detectors are electrically connected one another in series.

* * * * *